US006857760B2

(12) United States Patent
Chien

(10) Patent No.: US 6,857,760 B2
(45) Date of Patent: Feb. 22, 2005

(54) POWER OUTLET WITH NIGHT-VISION-FUNCTION

(76) Inventor: Chao Chuan Chien, 8F, No. 387, Chung Cheng Road., Hsin-Chuang City, Taipei Hsien (TW)

( * ) Notice: Subject to any disclaimer, the term of this patent is extended or adjusted under 35 U.S.C. 154(b) by 47 days.

(21) Appl. No.: 10/350,988

(22) Filed: Jan. 24, 2003

(65) Prior Publication Data

US 2004/0145912 A1 Jul. 29, 2004

(51) Int. Cl.[7] ..... H01R 33/00
(52) U.S. Cl. ..... 362/226; 362/95; 362/396; 362/800
(58) Field of Search ..... 362/396, 226, 362/95, 800

(56) References Cited

U.S. PATENT DOCUMENTS 5,708,554 A * 1/1998 Liner ..... 361/104
5,780,775 A * 7/1998 Yu ..... 174/135
6,010,228 A * 1/2000 Blackman et al. ..... 362/95
6,273,578 B1 * 8/2001 Lai ..... 362/95
6,431,719 B1 * 8/2002 Lau et al. ..... 362/95
2001/0033488 A1 * 10/2001 Chliwnyj et al. ..... 362/231
2002/0149938 A1 * 10/2002 Allen ..... 362/252
2002/0191396 A1 * 12/2002 Reiff et al. ..... 362/246

* cited by examiner

*Primary Examiner*—Thomas M. Sember
*Assistant Examiner*—Jacob Y Choi
(74) *Attorney, Agent, or Firm*—Quintero Law Office

(57) ABSTRACT

A power outlet with night-vision function, which at least comprising a housing, an outlet and plug module, a step-down and rectification circuit and a LED, characterized in: the outlet and plug module, step-down and rectification circuit and the LED are configured prior and then positioned in a mold, further, filled a insulating material into the mold so as to form the housing; wherein, upon the outlet and plug module connecting electrically to a AC power, the step-down and rectification circuit step-down and rectifies the AC power into a DC power and provides to the LED, such that the LED could emit various lights in various patterns so as to improve the visibility of the power outlet and replace a night-lamp in a chamber or a garden.

10 Claims, 1 Drawing Sheet

POWER OUTLET WITH NIGHT-VISION-FUNCTION

FIELD OF THE INVENTION

The present invention relates generally to the field of power outlet and, more particularly, to a power outlet with LED that could emit various lights and various patterns for providing night-vision in chamber or garden, wherein the housing of the power outlet is forming integrated.

BACKGROUND OF THE INVENTION

Generally speaking, a power outlet in accordance with the prior art has a housing, a plug and at least one outlet, wherein the housing comprises a upper cover and a lower cover mostly and the plug and the outlet are screwed into the upper cover and the lower cover for fixing purpose. However, the assembly process of the power outlet spends more time and the housing of the power outlet is damaged easily because the thickness of the housing is too thin. There is also a power outlet with a lamp in the market, wherein the lamp is a tungsten lamp or a halogen family lamp, however, the power consumption of the tungsten lamp and the halogen family lamp is high and the visibility of the tungsten lamp and the halogen family lamp is unexciting, in addition, the assembly process and the housing of the power outlet have the same defect as mention before.

As a result, an improved power outlet with night-vision function that reduces the power consumption of the lamp and provides various lights is needed. In addition, the housing of the power outlet is forming integrated such that could reduce the assembly time of the power outlet.

SUMMARY OF THE INVENTION

It is an object of the present invention to provide a power outlet with night-vision function for providing various night-vision functions in a chamber or a garden.

It is another object of the present invention to provide a power outlet with night-vision function, wherein the housing of the power outlet is forming integrated.

In accordance with one embodiment of the invention, an power outlet with night-vision function is provided which at least comprising a housing, an outlet and plug module, a step-down and rectification circuit and a LED, characterized in: the outlet and plug module, step-down and rectification circuit and the LED are configured prior and then positioned in a mold, further, filled a insulating material into the mold so as to form the housing; wherein, upon the outlet and plug module connecting electrically to a AC power, the step-down and rectification circuit step-down and rectifies the AC power into a DC power and provides to the LED, such that the LED could emit various lights in various patterns so as to improve the visibility of the power outlet and replace a night-lamp in a chamber or a garden.

BRIEF DESCRIPTION OF THE DRAWINGS

The novel features believed characteristic of the invention are set forth with particularity in the appended claims. The invention itself, however, as well as a preferred mode of use, further objectives and advantages thereof, will be best understood by reference to the following detailed description when read in conjunction with the accompanying drawings, wherein:

DETAILED DESCRIPTION OF THE PREFERRED EMBODIMENTS

Figure 1:
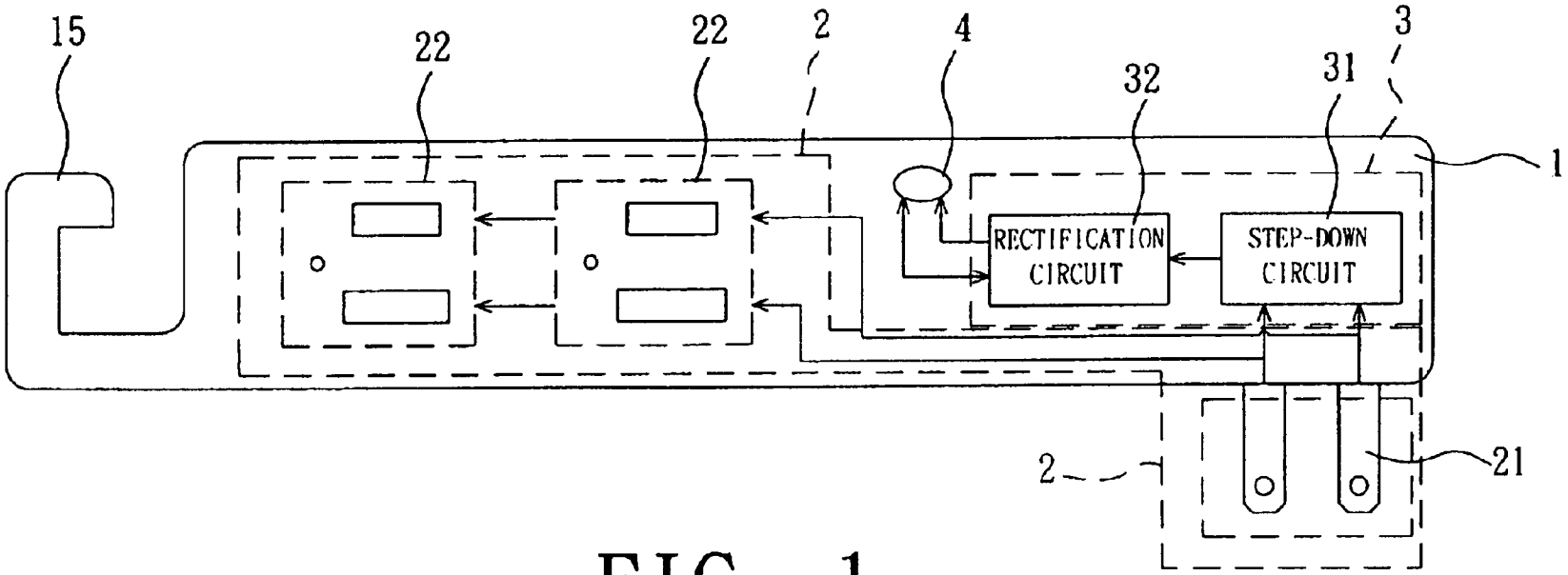
FIG. 1 depicts an assembly view of a power outlet with night-vision function in accordance with one embodiment of the present invention.

Referring first to FIG. 1, there is an assembly view of a power outlet with night-vision function in accordance with one embodiment of the present invention. The power outlet with night-vision function comprises: a housing 1, an outlet and plug module 2; a step-down and rectification circuit 3 and a LED 4.

Wherein, the characteristic of the present invention is: the outlet and plug module 2, step-down and rectification circuit 3 and the LED 4 are configured prior and positioned in a mold (not shown), further, filled a insulating material into the mold so as to form the housing 1, wherein the insulating material is a plastic material and the transparency of the plastic material more higher is preferably; wherein, upon the outlet and plug module 2 connecting electrically to a AC power (not shown), the step-down and rectification circuit 3 steps-down and rectifies the AC power into a DC power (for example, DC 5V) and provides to the LED 4, such that the LED 4 could emit various lights in various patterns so as to improve the visibility of the power outlet and replace a night-lamp in a chamber or a garden, wherein the LED 4 is a high brightness LED preferably. If the power outlet with night-vision function of the present invention positioned outdoor, the LED 4 of the power outlet could emit various lights in various patterns so as to improve the monotonous visibility of the power outlet of prior art.

Wherein, the outlet and plug module 2 further comprises a plug 21 and at least one outlet 22, wherein the outlet 22 is positioned on two opposite surfaces of the power outlet and the plug 22 is positioned on the other two surfaces of the power outlet.

Wherein, the step-down and rectification circuit 3 further comprising: a step-down circuit 31 for step-down the AC power, wherein the step-down circuit 31 is consisted of at least one resistor preferably; and a rectification circuit 32 is coupled to the step-down circuit 31 for rectification the AC power that is step-down prior into the DC power so as to provide the DC power to the LED 4, wherein the rectification circuit 32 is a full-wave rectifier (for example, a bridge rectifier) preferably. However, the shape of the housing 1 is a rectangular preferably, and the tail of the housing 1 could comprise a hook 15 for fixing purpose.

The description of the present invention has been presented for the purposes of illustration and description, but is not intended to be exhaustive or limited to the invention in the form disclosed. Many modifications and variations will be apparent to those of ordinary skill in the art. The embodiment was chosen and described to best explain the principles of the invention, the practical application, and to enable others of ordinary skill in the art to understand the invention for various embodiments with various modifications as suited to the particular use contemplated. While the invention has been described with reference to a preferred embodiment thereof, it is to be understood that modifications or variations may be easily made without departing from the spirit of this invention, which is defined by the appended claims.

What is claimed is:

1. A power outlet with night-vision function, comprising:

an outlet and plug module electrically connected to AC power;

a step-down and rectification circuit module electrically connected to said outlet and plug module, said step-down and rectification circuit rectifying said AC power into DC power;

a LED receiving power from said step-down and rectification circuit; and a housing formed of insulating material encasing said outlet and plug module, step-down and rectification circuit, and LED, said insulating material having sufficient transparency such that light from said LED is visible through said housing.

2. A power outlet with night-vision function as claimed in claim 1, wherein the outlet and plug module has a plug and at least one outlet, wherein said outlet is positioned on two opposite surfaces of said power outlet and said plug is positioned on the other two surfaces of said power outlet.

3. A power outlet with night-vision function as claimed in claim 1, wherein the step-down and rectification circuit further comprises:

a step-down circuit for step-down said AC power; and a rectification circuit is coupled to said step-down circuit for rectifying said AC power into said DC power so as to provide to said LED.

4. A power outlet with night-vision function as claimed in claim 3, wherein the step-down circuit comprises at least one resistor.

5. A power outlet with night-vision function as claimed in claim 3, wherein the rectification circuit is a full-wave rectifier.

6. A power outlet with night-vision function as claimed in claim 1, wherein the LED is a high brightness LED.

7. A power outlet with night-vision function as claimed in claim 1, wherein the insulating material is a plastic material.

8. A power outlet with night-vision function as claimed in claim 1, wherein the housing is a rectangular.

9. A power outlet with night-vision function as claimed in claim 8, wherein a tail of the housing further comprises a hook.

10. The power outlet with night-vision function as claimed in claim 1, wherein the housing consists of a single molded structure in which the said outlet and plug module, step-down and rectification circuit, and LED are embedded in predetermined positions.

* * * * *